US006196745B1

(12) United States Patent
Smith

(10) Patent No.: US 6,196,745 B1
(45) Date of Patent: Mar. 6, 2001

(54) ADAPTABLE REFILL, A COLLECTION OF WRITING INSTRUMENTS CAPABLE OF INCORPORATING SAME AS WELL AS A METHOD FOR REFILLING

(75) Inventor: Paul A. Smith, Glenview, IL (US)

(73) Assignee: Eversharp Pen Company, Franklin Park, IL (US)

( * ) Notice: Subject to any disclaimer, the term of this patent is extended or adjusted under 35 U.S.C. 154(b) by 0 days.

(21) Appl. No.: 09/250,754

(22) Filed: Feb. 16, 1999

(51) Int. Cl.[7] ..... B43K 7/02
(52) U.S. Cl. ..... 401/210
(58) Field of Search ..... 401/210, 209, 401/208, 195

(56) References Cited

U.S. PATENT DOCUMENTS

| | | | | |
|---|---|---|---|---|
| 2,803,219 | | 8/1957 | Stoeberl . | |
| 2,829,623 | | 4/1958 | Barnes . | |
| 2,860,602 | | 11/1958 | Fisher . | |
| 2,914,027 | * | 11/1959 | Sears | 401/210 |
| 3,039,437 | | 6/1962 | Walker . | |
| 3,119,377 | | 1/1964 | Johmann . | |
| 3,180,320 | * | 4/1965 | Groft | 401/210 |
| 3,346,100 | | 10/1967 | Carlson . | |
| 3,802,788 | * | 4/1974 | Danjczek | 401/194 |
| 4,756,097 | | 7/1988 | Sanders . | |
| 5,207,524 | | 5/1993 | Arnold, III . | |
| 5,615,964 | * | 4/1997 | Smith | 401/210 |
| 5,880,764 | * | 3/1999 | Barinaga | 347/86 |

* cited by examiner

*Primary Examiner*—Henry J. Recla
*Assistant Examiner*—Huyen Le
(74) *Attorney, Agent, or Firm*—Patents +TMS, P.C.

(57) ABSTRACT

A writing instrument having an adaptable refill is provided as well as a method for refilling any one of many commercially available writing instruments sold by various manufacturers. The adaptable refill includes a refill body and a variety of components attachable to the refill body in various orders depending on the writing instrument in which the adaptable refill is incorporated. The adaptable refill with the components may be purchased by a consumer and may fit any of the available writing instruments produced by various manufacturers. The components are constructed and designed to secure to the refill body of the adaptable refill in various orders or various arrangements to incorporate the adaptable refill into any one of many commercially available writing instruments. Preferably, the components are color-coded to provide simplified assembly instructions for identifying the preferred arrangement of components for attachment to the refill body based on the writing instrument in which the adaptable refill is to be incorporated.

20 Claims, 1 Drawing Sheet

ADAPTABLE REFILL, A COLLECTION OF WRITING INSTRUMENTS CAPABLE OF INCORPORATING SAME AS WELL AS A METHOD FOR REFILLING

BACKGROUND OF THE INVENTION

The present invention generally relates to a writing instrument. More specifically, the present invention relates to a refill for a writing instrument, namely an adaptable refill having a plurality of interchangeable components. The components are arrangeable in various configurations to fit any one of a plurality of writing instruments. In addition, the present invention provides a method for refilling any one of a plurality of writing instruments using the adaptable refill.

It is, of course, generally known to provide a writing instrument, such as a pen, for use in transcribing information or the like. Many types of pens exist such as ballpoint, roller ball, pressurized ballpoints, gel ink and the like. Typically, pens are constructed such that when ink from the pen is depleted, a refill within the body of the pen may be removed and replaced with a substitute refill. However, pens and their refills are produced by many different manufacturers. Typically, a specific pen requires a specific refill. Therefore, only the refill which is manufactured by the specific pen manufacturer fits the pen for which the refill is intended.

As a result, consumer confusion often exists when purchasing refills to determine which refill fits in the pen that the consumer originally purchased. Often, a consumer is not carrying the pen requiring the refill when purchase of a refill becomes necessary. The manufacturer of the refill may, therefore, not be known by the consumer, and often, the incorrect refill is purchased.

A need, therefore, exists for an adaptable refill that may be implemented in various types of writing instruments regardless of their manufacturers. In addition, a need exists for a collection of writing instruments, such as pens, capable of incorporating the adaptable refill as well as a method for refilling a writing instrument without regard to its manufacturer using the adaptable refill.

SUMMARY OF THE INVENTION

The present invention provides a writing instrument having an adaptable refill. More specifically, the present invention relates to an adaptable refill having a plurality of interchangeable components. The components are arrangeable in various configurations to fit all types of writing instruments regardless of their manufacturers. In addition, the present invention relates to a method for refilling any one of a plurality of available writing instruments.

To this end, in an embodiment of the present invention, an adaptable refill is provided. The adaptable refill has a body having a first end and a second end defining a length having an interior wherein the first end has a marking tip. A plurality of components is provided wherein at least one of the plurality of components is attachable at the first end of the body and at least another one of the plurality of components is attachable at the second end of the body wherein the plurality of components are independently attachable to the body.

In an embodiment, a plurality of components is independently attachable at the first end of the body.

In an embodiment, a plurality of components is independently attachable at a second end of the body.

In an embodiment, ink is provided in the interior of the body.

In an embodiment, a reduced diameter section is integrally formed with at least one of the plurality of components attachable to the second end of the body.

In an embodiment, a groove is formed in one of the plurality of components attachable to the first end of the body.

In an embodiment, the plurality of components is five wherein each of the plurality of components is independently attachable to the first end or the second end of the body.

In an embodiment, at least two of the plurality of components are attachable at either one of the first end or the second end of the body.

In an embodiment, each of the plurality of components is distinctly colored.

In another embodiment of the present invention, a collection of writing instruments is provided. The collection has a body having a length defined between the first end and a second end wherein the body has an interior wherein the interior of the body is distinct from another interior of a body produced by another manufacturer. Adaptable refill has a writing end and an opposite end. The refill is insertable into the interior of the body wherein the refill includes a plurality of components independently attachable to the refill to incorporate into any one of the interiors of the bodies.

In an embodiment, a plurality of components is independently attachable to the writing end of the adaptable refill.

In an embodiment, a plurality of components is independently attached to the opposite end of the adaptable refill.

In an embodiment, each of the plurality of components is distinctly colored.

In an embodiment, two of the plurality of components are attachable at either one of the first end or the second end of the body.

In another embodiment of the present invention, a method is provided for refilling any one of a plurality of available writing instruments. The method comprises the steps of: providing a body having a length defined between a first end and a second end; providing a plurality of components; and attaching at least one of the plurality of components independently to at least one of the first end or the second end of the body wherein attachment is dependent upon the writing instrument for which the refill is intended.

In an embodiment, color coding is provided for each one of the plurality of components.

In an embodiment, at least two of the plurality of components are attached to either one of the first end or the second end.

In an embodiment, a groove is provided in at least one of the plurality of components.

In an embodiment, the first end of the body has a tip capable of producing a mark.

In an embodiment, at least one of the plurality of components is attachable to both the first end and the second end of the body.

It is, therefore, an advantage of the present invention to provide a writing instrument, an adaptable refill therefor and a method for refilling that may be implemented in various types of writing instruments.

A further advantage of the present invention is to provide a writing instrument, an adaptable refill therefor and a method for refilling that allows removal of the refill from the writing instrument and incorporated in another writing instrument.

A still further advantage of the present invention is to provide a writing instrument, an adaptable refill therefor and a method for refilling that simply adapts between various writing instruments regardless of their manufacturers.

And, another advantage of the present invention is to provide an adaptable refill for a writing instrument and a method for refilling that incorporates a minimum number of parts easily assembled regardless of the manufacturer of the writing instrument for which the refill is intended for use.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figures 1, 2, 3, 4, 5, 6, 7:
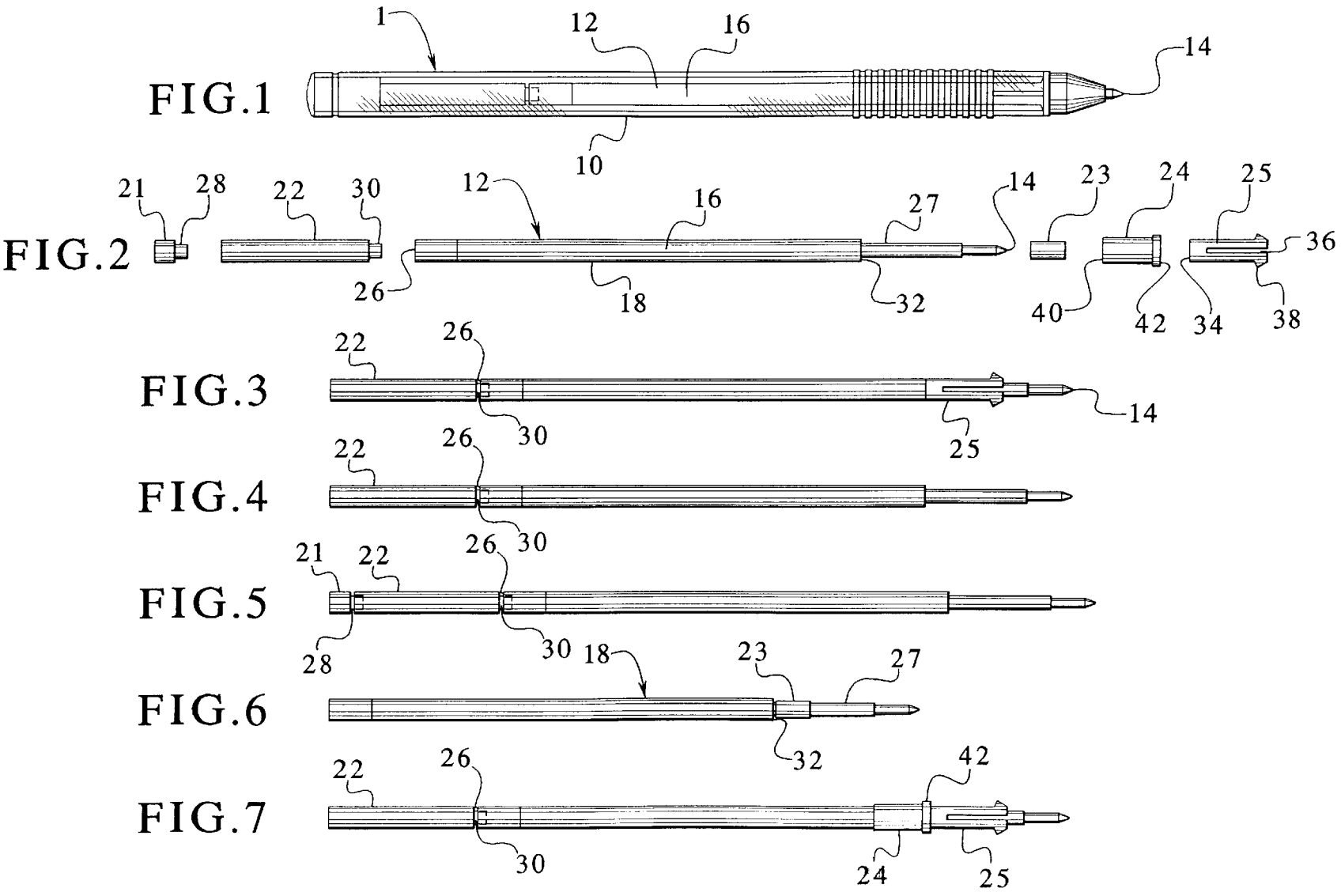
FIG. 1 illustrates a plan view of a writing instrument incorporating an embodiment of an adaptable refill of the present invention.
FIG. 2 illustrates an exploded plan view of an embodiment of an adaptable refill of the present invention.
FIG. 3 illustrates a plan view of an embodiment of an assembled adaptable refill of the present invention.
FIG. 4 illustrates a plan view of another embodiment of an assembled adaptable refill of the present invention.
FIG. 5 illustrates a plan view of another embodiment of an assembled adaptable refill of the present invention.
FIG. 6 illustrates a plan view of another embodiment of an assembled adaptable refill of the present invention.
FIG. 7 illustrates a plan view of another embodiment of an assembled adaptable refill of the present invention.

The present invention generally relates to a writing instrument and more specifically relates to a writing instrument incorporating an adaptable refill. The adaptable refill of the present invention is capable of incorporation into any one of many known and available writing instruments regardless of the manufacturer thereof. The adaptable refill includes a plurality of parts or components easily assembled into a variety of orientations depending on the writing instrument in which the same is incorporated.

Although a single writing instrument body is shown in FIG. 1, it should be appreciated that various constructions and designs of bodies of writing instruments are generally known and available. The present invention allows incorporation of the adaptable refill into any one of a collection of such writing instruments. In addition, the present invention relates to a method for refilling any one of a plurality of available writing instruments through purchase of a single refill by a consumer or the like.

Referring now to the drawings wherein like numerals refer to like parts, FIG. 1 generally illustrates a writing instrument 1 including a body 10 in which an adaptable refill 12 may be incorporated. The adaptable refill 12 includes a writing tip 14 through which ink 16 or other like writing fluid may flow to the tip 14 for transcribing, for example, information onto paper or the like. The use of a writing instrument is conventional in the art, and the present invention is not directed to the actual use of the pen with the adaptable refill, itself, but is more specifically directed to a writing instrument provided by one of many manufacturers in which the adaptable refill 12 of the present invention may be incorporated.

Referring now to FIG. 2, an exploded view of the adaptable refill 12 is shown. As illustrated, the adaptable refill 12 includes at least six components. One or more of those components is attached to a refill body 18. The refill body 18 is the basic component necessary for incorporation into any one of the writing instruments manufactured by various manufacturers. The refill body 18 includes the ink 16 and the writing tip 14 through which the ink 16 or other fluid flows to use the writing instrument as desired.

In addition, five other components generally designated 21, 22, 23, 24 and 25 are shown. The components 21–25 are designed to attach to the refill body 18 or another one of the components 21–25 in a predetermined manner. Namely, two components 21 and 22 are provided for attachment to one end 26 of the refill body 18. The component 21 is attachable directly to the refill body 18 or may be attachable to the refill body 18 via the component 22 as generally illustrated in FIG. 5. To this end, the components 21 and 22 each may include a reduced diameter section 28, 30 having an outer circumference slightly smaller than an opening in the end 26 of the refill body 18. Therefore, the component 21 or 22 may be frictionally inserted into an opening at the end 26 of the refill body 18 depending on the particular writing instrument 1 in which the adaptable refill 12 is intended for incorporation.

Similarly, the components 23, 24 and 25 are provided for securing to an opposite end 27 of the refill body 18. To this end, the end 27 has a reduced diameter from the refill body 18 such that the components 23, 24 and/or 25 frictionally secure around the end 27 as generally illustrated in FIGS. 3, 6 and 7.

As shown in FIG. 3, the component 25 is slidably received around the end 27 and secures to the end 27 of the refill body 18 at a portion which forms a lip 32 of the refill body 18. An end 34 of the component 25 is prevented from further advancement onto the refill body 18 by the lip 32. A recess 36 is formed beginning at an opposite end of the component 25 and extends into the body of the component 25 towards the end 34 of the component 25. The recess 36 allows slight expansion and contraction of the component 25 when frictionally advancing the component 25 along the end 27 of the refill body 18 to the position generally illustrated in FIGS. 3 or 7. The component 25 also includes a flange 38 necessary for use in engagement of the adaptable refill 12 within certain writing instruments.

Referring to FIG. 6, the component 23 is provided for frictionally engaging along the end 27 of the refill body 18 of the adaptable refill 12. The component 23 has a substantially uniform diameter and slightly reduced diameter from the lip 32 of the refill body 18. In addition, the exterior diameter of the component 23 is slightly greater than the diameter of the end 27 of the refill body 18.

Finally, use of the component 24 is generally shown and illustrated with reference to FIG. 7. The component 24 includes a first end 40 having an opening that extends through to an opposite end 42. The opposite end 42 has a diameter greater than the end 40. The component 24 may be frictionally engaged around the end 27 of the refill body 18 as generally shown with respect to FIG. 7. As further shown in FIG. 7, the lip 32 allows advancement of the component 24 around the lip and stops advancement thereof at the end 42 that includes a larger diameter. At that point, the component 25 may be frictionally secured around the end 27 of the refill body 18 as generally shown and illustrated with reference to FIG. 7 and previously described with reference to FIG. 4 without the component 24.

Although various arrangements of the components 21–25 are generally shown and illustrated with reference to FIGS. 3–7, it should be understood that many other arrangements may be provided depending on the particular writing instrument in which the adaptable refill 12 is incorporated for use. The specific design of the components 21–25 may also be varied in order to customize the adaptable refill 12 for other writing instruments or the like.

In addition, in a preferred embodiment, the components 21–25 of the adaptable refill 12 are distinctly colored. For example, the component 21 may be green; the component 22 may be black; the component 23 may be yellow; the component 24 may be white; and the component 25 may be cyan. A diagram may be provided on, for example, packaging of the refill 12, along with information associated with the various writing instruments produced by its respective manufacturer in which the refill 12 may be implemented. The colored components 21–25 clearly demonstrate the assembly of the various components 21–25 to the refill body 18. The order of securing one or more of the components 21–25 to the refill body 18 for use within the specific body 10 of the writing instrument 1 is dependent on, for example, the manufacturer of the pen.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An adaptable refill comprising:

a body having a first end and a second end defining a length between the first end and the second end, the body further having an interior and a substantially uniform diameter along a majority of the length of the body and further wherein the first end has a marking tip; and a plurality of components independently attachable to the body wherein at least one of the plurality of components is attachable at the first end of the body and at least another one of the plurality of components is attachable at the second end of the body wherein at least one of the plurality of components attachable at the second end of the body has a section having a reduced diameter relative to the diameter of the body for insertion of the section into the second end of the body and further wherein at least one of the plurality of components attachable at the first end of the body has a diameter greater than the diameter of the body.

2. The adaptable refill of claim 1 further comprising:

a plurality of components independently attachable at the first end of the body.

3. The adaptable refill of claim 1 further comprising:

a plurality of components independently attachable at a second end of the body.

4. The adaptable refill of claim 1 further comprising:

ink in the interior of the body.

5. The attachable refill of claim 1 further comprising:

a reduced diameter section integrally formed with at least one of the plurality of components attachable to the second end of the body.

6. The attachable refill of claim 1 further comprising:

a groove formed in one of the plurality of components attachable to the first end of the body.

7. The attachable refill of claim 1 wherein the plurality of components is five wherein each of the plurality of components is independently attachable to the first end or the second end of the body.

8. The attachable refill of claim 1 wherein at least two of the plurality of components are attachable at either one of the first end or the second end of the body.

9. The attachable refill of claim 1 wherein each of the plurality of components is distinctly colored.

10. A collection of writing instruments, the collection comprising:

a body having a length defined between the first end and a second end wherein the body has an interior and a substantially uniform diameter along a majority of the length of the body and further wherein the interior of the body is distinct from another interior of a body produced by another manufacturer; and an adaptable refill having a writing end and an opposite end, the refill insertable into the interior of the body wherein the refill includes a plurality of components independently attachable to the refill to incorporate into any one of the interiors of the bodies wherein at least one of the plurality of components attachable at the opposite end of the refill has a section having a reduced diameter relative to the refill for insertion of the section into the opposite end of the refill and wherein at least one of the plurality of components attachable at the writing end of the refill has a diameter greater than the diameter of the refill.

11. The collection of claim 10 further comprising:

a plurality of components independently attachable to the writing end of the adaptable refill.

12. The collection of claim 10 further comprising:

a plurality of components independently attached to the opposite end of the adaptable refill.

13. The collection of claim 10 wherein the each of the plurality of components is distinctly colored.

14. The collection of claim 10 wherein at least two of the plurality of components are attachable at either one of the first end or the second end of the body.

15. A method for refilling any one of a plurality of available writing instruments, the method comprising the steps of:

providing a refill having a body, the body having a length defined between a first end and a second end wherein the body has a substantially uniform diameter along a majority of the length of the body;

providing a plurality of components; and attaching at least one of the plurality of components independently to at least one of the first end or the second end of the body wherein attachment is dependent upon the writing instrument for which the refill is intended and further wherein at least one of the components attachable at the second end of the refill has a section having a reduced diameter relative to the refill for insertion of the section into the second end of the refill and wherein at least one of the plurality of components attachable at the first end of the body has a diameter greater than the diameter of the body.

16. The method of claim 15 further comprising the step of:

color coding each one of the plurality of components.

17. The method of claim 15 further comprising the step of:

attaching at least two of the plurality of components to either one of the first end or the second end.

18. The method of claim 15 further comprising the step of:

providing a groove in at least one of the plurality of components.

19. The method of claim 15 wherein the first end of the body has a tip capable of producing a mark.

20. The method of claim 15 wherein at least one of the plurality of components is attachable to both the first end and the second end of the body.

* * * * *